US006773043B2

(12) United States Patent
Taga

(10) Patent No.: US 6,773,043 B2
(45) Date of Patent: Aug. 10, 2004

(54) DRIVE APPARATUS OF TRUNK LID LOCK FOR MOTOR VEHICLE

(75) Inventor: Shigenori Taga, Yokohama (JP)

(73) Assignee: Ohi Seisakusho Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/900,432

(22) Filed: Jul. 6, 2001

(65) Prior Publication Data

US 2002/0003351 A1 Jan. 10, 2002

(30) Foreign Application Priority Data

Jul. 7, 2000 (JP) ..... 2000-205994

(51) Int. Cl.[7] ..... E05B 15/02

(52) U.S. Cl. ..... 292/341.16; 292/DIG. 23; 292/DIG. 43; 292/201

(58) Field of Search ..... 292/341.16, 201, 292/DIG. 43; 49/279, 280

(56) References Cited

U.S. PATENT DOCUMENTS 4,652,027 A * 3/1987 Quantz ..... 292/201
4,763,936 A * 8/1988 Rogakos et al. ..... 292/201
5,007,261 A * 4/1991 Quantz ..... 70/240
RE33,758 E * 12/1991 Compeau et al. ..... 292/216
5,429,400 A * 7/1995 Kawaguchi et al. ..... 292/201
5,443,292 A * 8/1995 Shimada et al. ..... 292/341.16
5,868,444 A * 2/1999 Brackmann et al. ..... 292/201
5,934,717 A * 8/1999 Wirths et al. ..... 292/201
6,109,671 A * 8/2000 Roncin et al. ..... 292/216
6,176,528 B1 * 1/2001 Taga ..... 292/341.16
6,193,288 B1 * 2/2001 Taga et al. ..... 292/341.16
6,422,615 B1 * 7/2002 Roos et al. ..... 292/216

FOREIGN PATENT DOCUMENTS

JP P 2000-038163 2/2000

* cited by examiner

*Primary Examiner*—Robert J. Sandy
*Assistant Examiner*—Thomas Ho
(74) *Attorney, Agent, or Firm*—Brenda O. Holmes; Kilpatrick Stockton LLP

(57) ABSTRACT

When a trunk lid 10 is opened, even in the case that the trunk lid 10 is attached to a weather strip due to a frost of a vehicle body and the trunk lid 10 is not sufficiently opened, a lock canceling member 60 is restricted at an restriction canceling position during a period that a striker 45 is returned to a waiting position from a bring-in position. Furthermore, a latch 31 is not again engaged with the striker 45, and a drive mechanism 50 does not bring in the trunk lid 10 again.

4 Claims, 6 Drawing Sheets

DRIVE APPARATUS OF TRUNK LID LOCK FOR MOTOR VEHICLE

BACKGROUND OF THE INVENTION

1. Field of the Invention

The present invention relates to a drive apparatus of a trunk lid lock for a motor vehicle in which a striker is provided in one of a trunk lid and a peripheral edge portion of a trunk opening, and a latch is provided in another of the trunk lid and the peripheral edge portion of the trunk opening. More particularly, the present invention relates to a drive apparatus of a trunk lid lock for a motor vehicle structured such that when the striker is engaged with the latch, a drive mechanism is operated so as to bring in the latch via the striker, thereby closing the trunk lid.

2. Description of the Related Art

As the drive apparatus of the trunk lid lock for the motor vehicle, there is conventionally known a structure shown in FIG. 1 (Japanese Patent Application Laid-Open No. 2000-38163).

A lock mechanism 1 is arranged in a side of a trunk lid, and a drive apparatus 2 (a closure apparatus) is provided in a side of a peripheral edge portion of a trunk opening. When the trunk lid is going to be closed, a striker 3 in the side of the drive apparatus 2 is engaged with a latch 4 of the lock mechanism 1, and a drive mechanism 5 of the drive apparatus 2 under a bring-in starting state is operated. When the striker 3 moves from a waiting position to a bring-in position under the state of being engaged with the latch 4, the latch 4 is brought in via the striker 3 and the trunk lid is closed. When the trunk lid is fully closed, the drive mechanism 5 stops operating and the bring-in operation is finished.

In the case that the trunk lid is under the fully closed state, when the striker 3 comes off from the latch 4 by operating an canceling actuator 6 provided in the side of the lock mechanism 1, the trunk lid is allowed to be opened. When the drive mechanism 5 starts operating and the striker 3 returns to the waiting position from the bring-in position, the drive mechanism 5 stops operating. A lid state detecting portion 7 for detecting an opening and closing condition of the trunk lid is provided in the drive apparatus 2.

However, in the proposed drive apparatus of the trunk lid lock for the motor vehicle described above, in the case that a weather strip provided along the peripheral edge of the trunk opening is attached to the trunk lid due to frost of a vehicle body and the trunk lid can not be sufficiently opened, the latch 4 is engaged with the striker 3 in a state that the striker 3 does not return to the waiting position even if it is intended to operate the canceling actuator 6 so as to take out the striker 3 from the latch 4. Accordingly, the drive apparatus 2 erroneously operates and the striker 3 brings in the latch 4 again, thereby the trunk lid is closed.

When the lid state detecting portion 7 detects that the trunk lid is under the state of not being sufficiently opened, the canceling actuator 6 is operated so that the latch 4 is not engaged with the striker 3, whereby the drive apparatus 2 is prevented from being erroneously operated. However, in the drive apparatus 2 described above, the canceling actuator 6 and the lid state detecting portion 7 are required, so that there are problems that a number of the parts is increased and a product cost is hard to be reduced.

SUMMARY OF THE INVENTION

The present invention is made by paying attention to the problem in the proposed drive apparatus of the trunk lid lock, and an object of the present invention is to provide a drive apparatus of a trunk lid lock for a motor vehicle in which a canceling actuator and a lid state detecting portion or the like are not required and the number of parts can be reduced, so that a cost can be reduced.

The first aspect of the invention provides a drive apparatus of a trunk lid lock for a motor vehicle, comprising: a striker provided in one of a trunk lid and a peripheral edge portion of a trunk opening; a latch provided in the other of the trunk lid and the peripheral edge portion of the trunk opening; and a drive mechanism having a lock canceling member, wherein when the latch is engaged with the striker, the drive mechanism is operated so as to bring in a second member including the latch via a first member including the striker moving to a bring-in position from a waiting position, thereby closing the trunk lid, wherein the lock canceling member can move to a restricting position at which the latch is under a restricting state that the latch can not be taken out from the striker, and an restriction canceling position at which the latch is under a restriction canceling state that the latch can be taken out from the striker, wherein the drive mechanism drives the lock canceling member from the restricting position to the restriction canceling position at a time that the first member is returned to the waiting position from the bring-in position, and wherein during a period that the first member is returned to the waiting position from the bring-in position, the lock canceling member is restricted to the restriction canceling position, and after returning the first member to the waiting position, the lock canceling member can be moved from the restriction canceling position to the restricting position.

The second aspect of the invention provides a drive apparatus of a trunk lid lock for a motor vehicle according to the first aspect of the invention, wherein the drive mechanism further comprising: an output member, wherein the output member drives the lock canceling member from the restricting position to the restriction canceling position at a time that the first member is returned to the waiting position from the bring-in position, and wherein during a period that the first member is returned to the waiting position from the bring-in position, the lock canceling member is restricted at the restriction canceling position, and after returning the first member to the waiting position, the lock canceling member can be moved from the restriction canceling position to the restricting position.

The third aspect of the invention provides a drive apparatus of a trunk lid lock for a motor vehicle according to the second aspect of the invention, wherein the lock canceling member comprising: a first cam; a second cam; and a third cam, wherein the output member is relatively brought into slidable contact with the first cam at a time that the first member is returned to the waiting position from the bring-in position, whereby the lock canceling member is moved from the restricting position to the restriction canceling position, wherein during a period that the first member is returned to the waiting position from the bring-in position, the output member is relatively brought into slidable contact with the second cam, whereby the lock canceling member is restricted at the restriction canceling position, and wherein after returning the first member to the waiting position, the output member is relatively brought into slidable contact with the third cam, whereby the lock canceling member can be moved from the restriction canceling position to the restricting position.

The fourth aspect of the invention provides a drive apparatus of a trunk lid lock for a motor vehicle according to the first aspect of the invention, wherein the second member is provided with a locking plate which can move to a restriction canceling position for making the latch in a restriction canceling state.

The fifth aspect of the invention provides a drive apparatus of a trunk lid lock for a motor vehicle according to the second aspect of the invention, wherein the output member comprising: a cam follower bringing in the second member via the first member, the cam follower being relatively brought into slidable contact with a cam groove formed in the first member, wherein the cam follower is relatively brought into slidable contact with the first cam, the second cam and the third cam in this order.

The sixth aspect of the invention provides a drive apparatus of a trunk lid lock for a motor vehicle according to the fifth aspect of the invention, wherein the cam follower moves along a circumference, wherein the second cam is formed along the circumference at a time that the lock canceling member is at the restriction canceling position, and wherein the first cam and the third cam are respectively connected to both sides of the second cam, and are formed so as to gradually move close to or apart from a center of the circumference respectively.

The seventh aspect of the invention provides a drive apparatus of a trunk lid lock for a motor vehicle according to the first aspect of the invention, wherein the lock canceling member is urged from the restriction canceling position to the restricting position by a coil spring.

DETAILED DESCRIPTION OF THE PREFERRED EMBODIMENTS

Hereinafter, an embodiment according to the present invention will be described with reference to the accompanying drawings.

Figure 1:
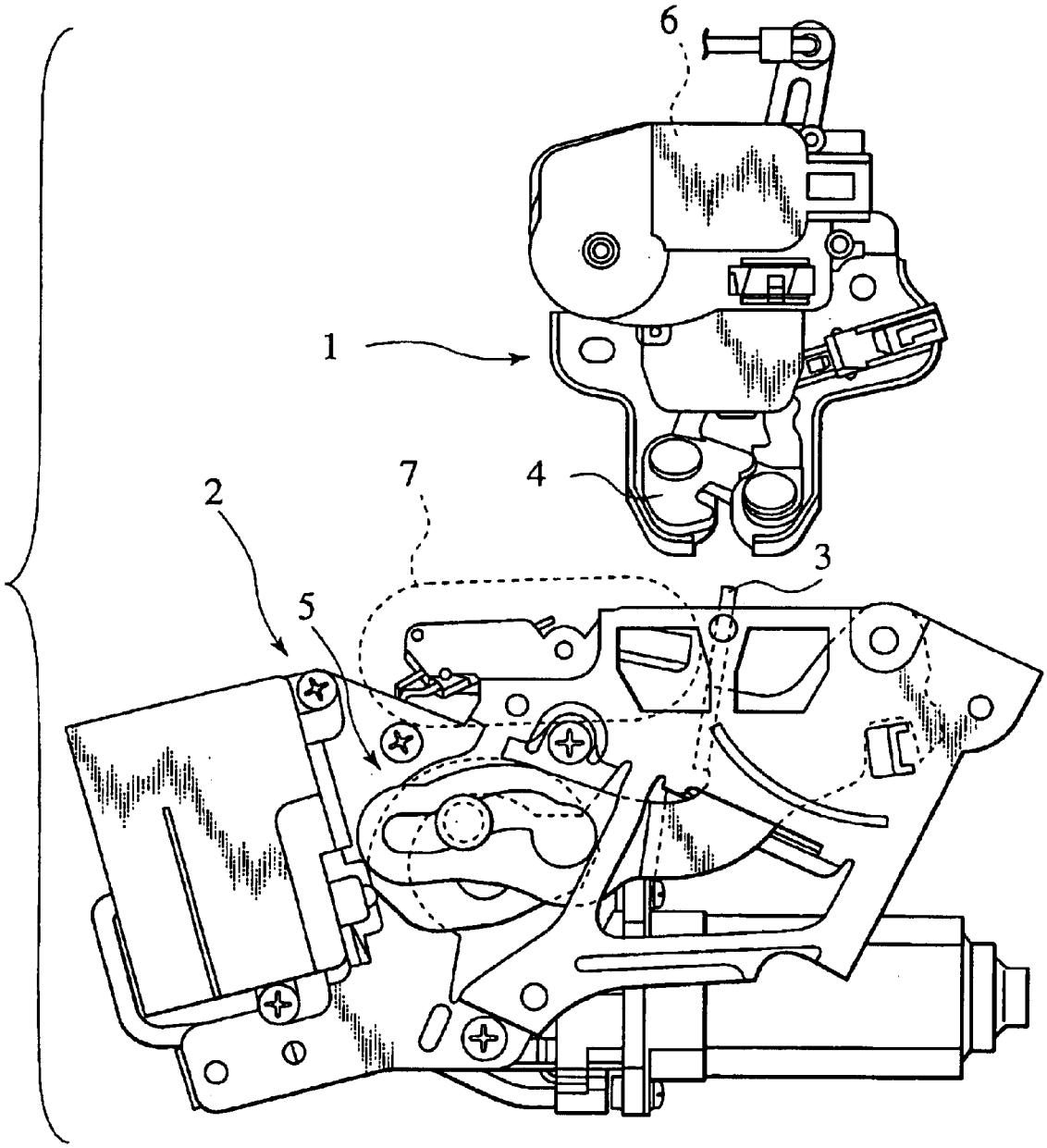
FIG.1 PRIOR ART
FIG. 1 is a front elevational view of a conventional drive apparatus of a trunk lid lock.
Figure 2:
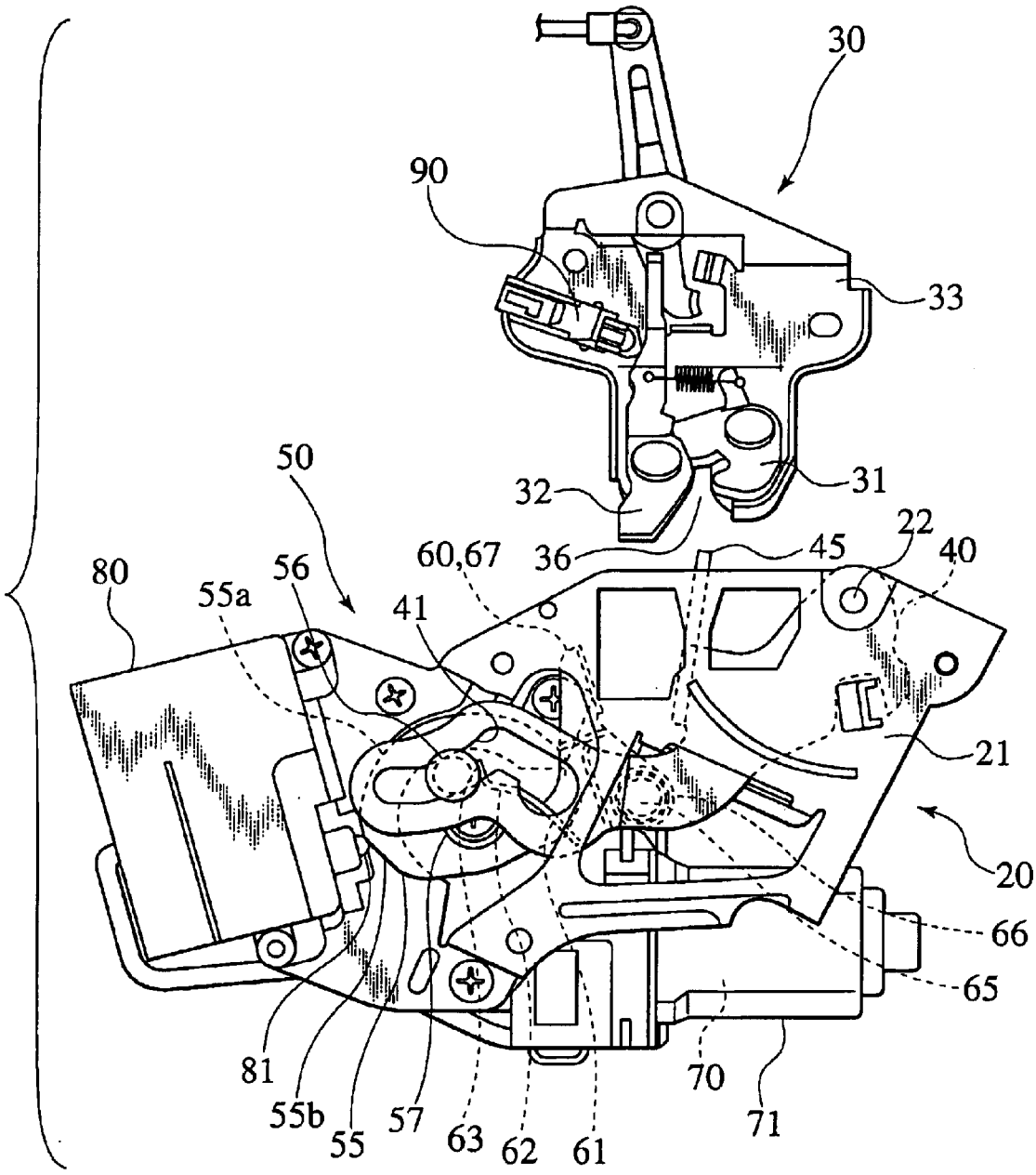
FIG. 2 is a front elevational view of a drive apparatus of a trunk lid lock according to an embodiment of the present invention.
Figure 3:
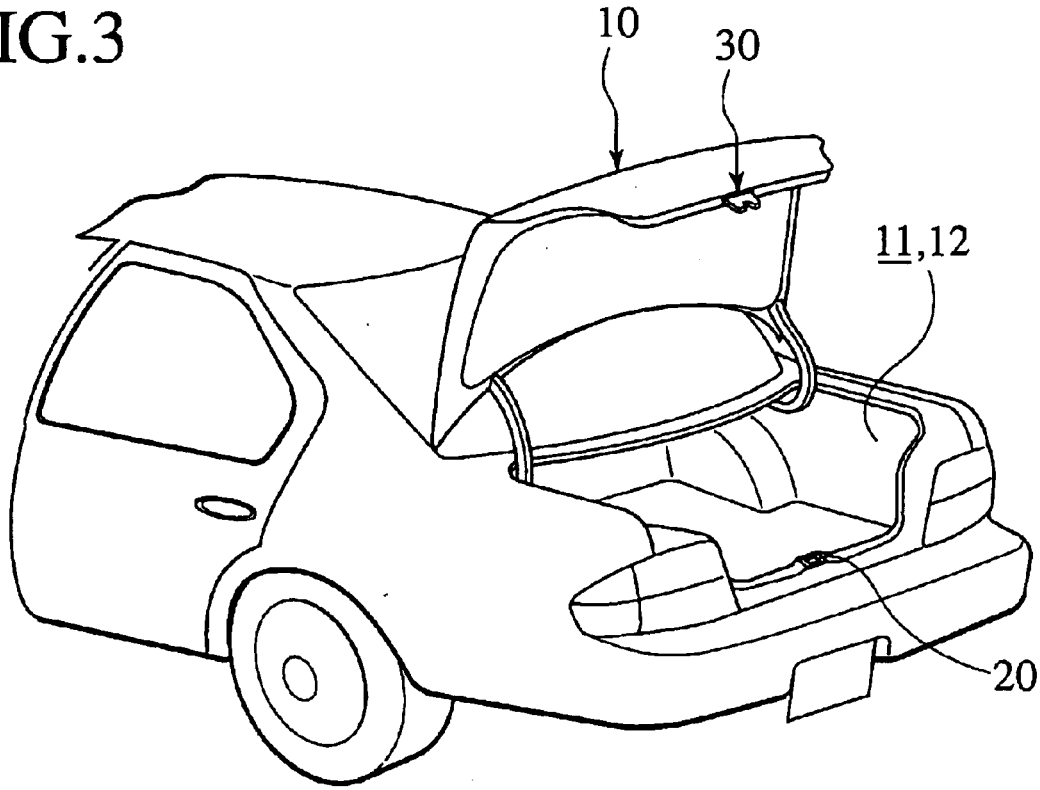
FIG. 3 is a perspective view showing a state that the drive apparatus of the trunk lid lock shown in FIG. 2 is attached to a trunk.
Figure 4:
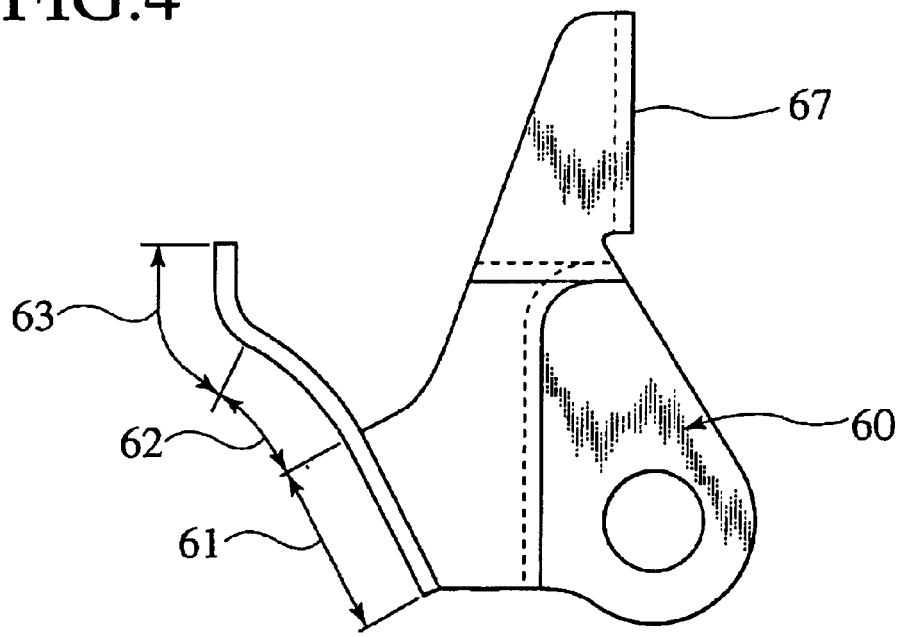
FIG. 4 is a front elevational view of a lock canceling member in the drive apparatus of the trunk lid lock shown in FIG. 2.

As shown in FIGS. 2 and 3, a lock apparatus 30 is provided in a trunk lid 10. A weather strip (not shown) is attached to a peripheral edge of a trunk opening 11. A drive apparatus 20 is attached to a peripheral edge portion 12 of the trunk opening 11 in correspondence to the lock apparatus 30.

The drive apparatus 20 has a support base 21 fixed to an inner panel of the peripheral edge portion 12 in the trunk opening 11, and a striker base 40.

Figure 5:
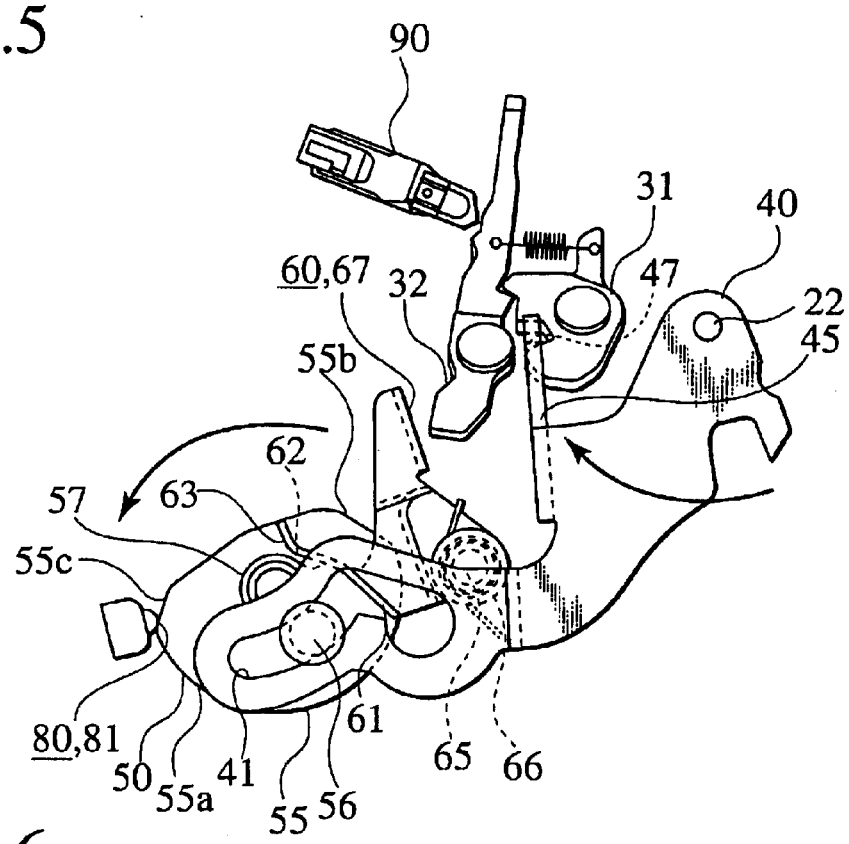
FIG. 5 is a front elevational view showing that the drive apparatus for setting the trunk lid to a state capable of opening is under a starting state.

One end of the striker base 40 is pivotally attached to the support base 21 by a pivot pin 22. A striker 45 is integrally formed at a middle position apart from one end of the striker base 40 toward another end. The striker 45 swings between a waiting position shown in FIG. 8 at which another end of the striker base 40 is ascended and a bring-in position shown in FIG. 5 at which another end of the striker base 40 is descended.

The striker 45 has a flat-shaped bent portion 46 formed by bending the striker base 40, and a head portion 48 disposed in an upper edge of the bent portion 46 and formed by piercing an engaging hole 47 in the bent portion 46. The striker 45 moves forward and backward with respect to a striker approaching groove 36 formed in a lock base 33 of the lock apparatus 30 at a time of swinging between a waiting position shown in FIG. 8 and a bring-in position shown in FIG. 5. In the lock base 33, a latch 31 engaging with and disengaging from the striker 45 and a locking plate 32 are provided so as to be opposed to each other with disposing the striker approaching groove 36 therebetween. The locking plate 32 is supported so as to be capable of swinging between a restricting position for making the latch 31 in a state of not being taken out from the striker 45, and a restriction canceling position for making the latch 31 in a state of being taken out from the striker 45.

A drive mechanism 50 for bringing in the latch 31 via the striker 45 is attached to another end of the support base 21. A cam groove 41 is formed in another end of the striker base 40.

The drive mechanism 50 has an output member 55 rotatably supported to another end of the support base 21. A cam follower 56 is protruded from a surface of the output member 55, and the cam follower 56 is movably fitted to the cam groove 41.

A rotary shaft 57 is provided in a center portion of the output member 55, and the rotary shaft 57 extends through the support base 21 so as to protrude to a side of a power portion 70 fixed to the support base 21.

A drive motor and a reduction gear (both not shown) are received within a housing 71 of the power portion 70. A bring-in state detecting portion 80 is attached to another end of the support base 21, and a switch 81 of the bring-in state detecting portion 80 is brought into slidable contact with a peripheral edge of the output member 55. The peripheral edge of the output member 55 is constituted by a semicircular portion 55*a*, and first and second detected portions 55*b* and 55*c* respectively formed in both ends of the semicircular portion 55*a*. The first detected portion 55*b* corresponds to a detected portion for a waiting position, and the second detected portion 55*c* corresponds to a detected portion for a bring-in position.

In the support base 21, a lock canceling member 60 is supported by a shaft 65. The lock canceling member 60 can swing from the restriction canceling position to the restricting position. A coil spring 66 is wound around the shaft 65. The lock canceling member 60 is urged to a direction of swinging to the restricting position from the restriction canceling position (a direction of a right-directed arrow above the lock canceling member 60 in FIG. 6) by the coil spring 66.

The lock canceling member 60 comprises two tongues around the shaft 65. An operating flange 67 for operating the locking plate 32 is formed in one tongue close to the striker 45. On the contrary, a first cam 61, a second cam 62 and a third cam 63 respectively brought into slidable contact with the cam follower 56 relatively are formed in the other tongue close to the output member 55. The second cam 62 is formed so as to be along a circumference corresponding to a track of the cam follower 56 when the lock canceling member 60 is at the restriction canceling position. The first cam 61 and the third cam 63 respectively overlap with both sides of the second cam 62 and are formed so as to gradually move close to a center of the circumference or gradually move apart from the center of the circumference, with respect to the circumference described above.

The cam follower 56 of the output member 55 is relatively brought into slidable contact with the first cam 61 at a time of returning the striker 45 to the waiting position from the bring-in position, thereby moving the lock canceling member 60 from the restricting position to the restriction canceling position. Since the cam follower 56 is relatively brought into slidable contact with the second cam 62 during the period that the striker 45 is returned to the waiting position from the bring-in position, thereby the lock canceling member 60 is restricted at the restriction canceling position. The cam follower 56 is relatively brought into slidable contact with the third cam 63 after returning the striker 45 to the waiting position, whereby the lock canceling member 60 can be moved to the restricting position from the restriction canceling position.

Figure 8:
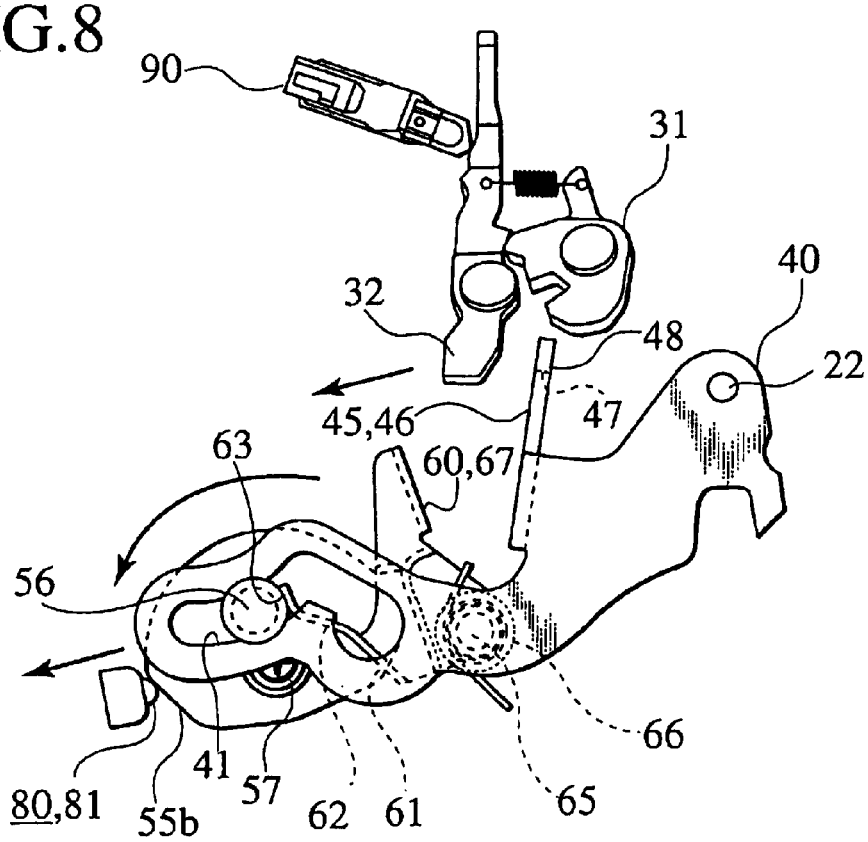
FIG. 8 is a front elevational view showing a state that the lock canceling member in the drive apparatus of the trunk lid is moved to a restricting position.

In the opening state of the trunk lid 10, as shown in FIG. 8, another end of the striker base 40 is ascended and the striker 45 is at the waiting position. At this time, the switch 81 of the bring-in state detecting portion 80 protrudes so as to be brought into contact with the first detected portion 55*b*. The locking plate 32 exists at the restriction canceling position, and the latch 31 is under the non-engaged state.

When the trunk lid 10 is going to be closed, the striker 45 at the waiting position moves forward to the striker approaching groove 36 of the lock apparatus 30. In due time, when the latch 31 is engaged with the striker 45, the drive apparatus 20 is started by a sensor 90 operated in correspondence to a movement of the locking plate 32 to the restricting position. Furthermore, the output member 55 of the drive mechanism 50 is operated by the power portion 70.

When the output member 55 is operated, the cam follower 56 of the output member 55 moves within the cam groove 41 of the striker base 40. Then, another end of the striker base 40 rotates around the shaft 65 in a counterclockwise direction so as to be descended. On the contrary, one end of the striker base 40 is drawn upward, and the striker 45 moves in a direction of engaging with the latch 31 against a restoring force of the weather strip provided along the peripheral edge portion 12 of the trunk opening 11. When another end of the striker base 40 is drawn down, the switch 81 of the bring-in state detecting portion 80 slides on the semicircular portion 55*a* of the output member 55.

Furthermore, when the output member 55 rotates and the cam follower 56 moves within the cam groove 41, the striker base 40 swings, the striker brings in the latch, and the trunk lid 10 is going to be closed. When the switch 81 of the bring-in state detecting portion 80 slides on the second detected portion 55*c* of the of the output member 55, the switch 81 is protruded and it is detected that the striker 45 swings to the bring-in position (shown in FIG. 5), the drive motor stops and the trunk opening 11 is fully closed.

Even in the case that the restoring force of the weather strip (not shown) provided along the peripheral edge portion 12 of the trunk opening 11 is great, the drive mechanism 50 brings in the trunk lid 10 against the restoring force and deflect the weather strip, whereby the trunk lid 10 can be fully closed.

In the state that the trunk lid 10 is closed, the output member 55 is kept in a state of not being brought into contact with the lock canceling member 60. Accordingly, the lock canceling member 60 is not driven to the restriction canceling position from the restricting position, and the latch 31 is kept in the restricted state in which the latch 31 can not be removed from the striker 45.

The drive motor of the drive portion 70 is started by turning on the canceling switch (not shown) so as to open the trunk lid 10, and the output member 55 rotates. When the output member 55 rotates, the cam follower 56 moves within the cam groove 41 and the striker 45 ascends from the bring-in position. The lock apparatus 30 is pushed upward in correspondence to the ascending striker 45.

Figure 6:
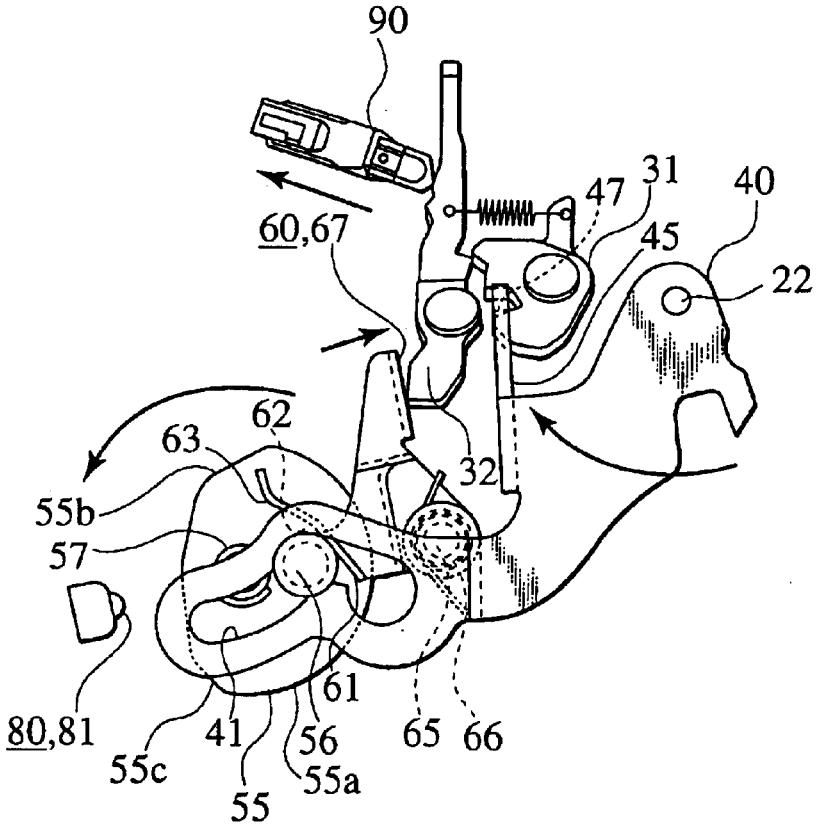
FIG. 6 is a front elevational view showing a state that the lock canceling member in the drive apparatus of the trunk lid is driven to an restriction canceling position.
Figure 9:
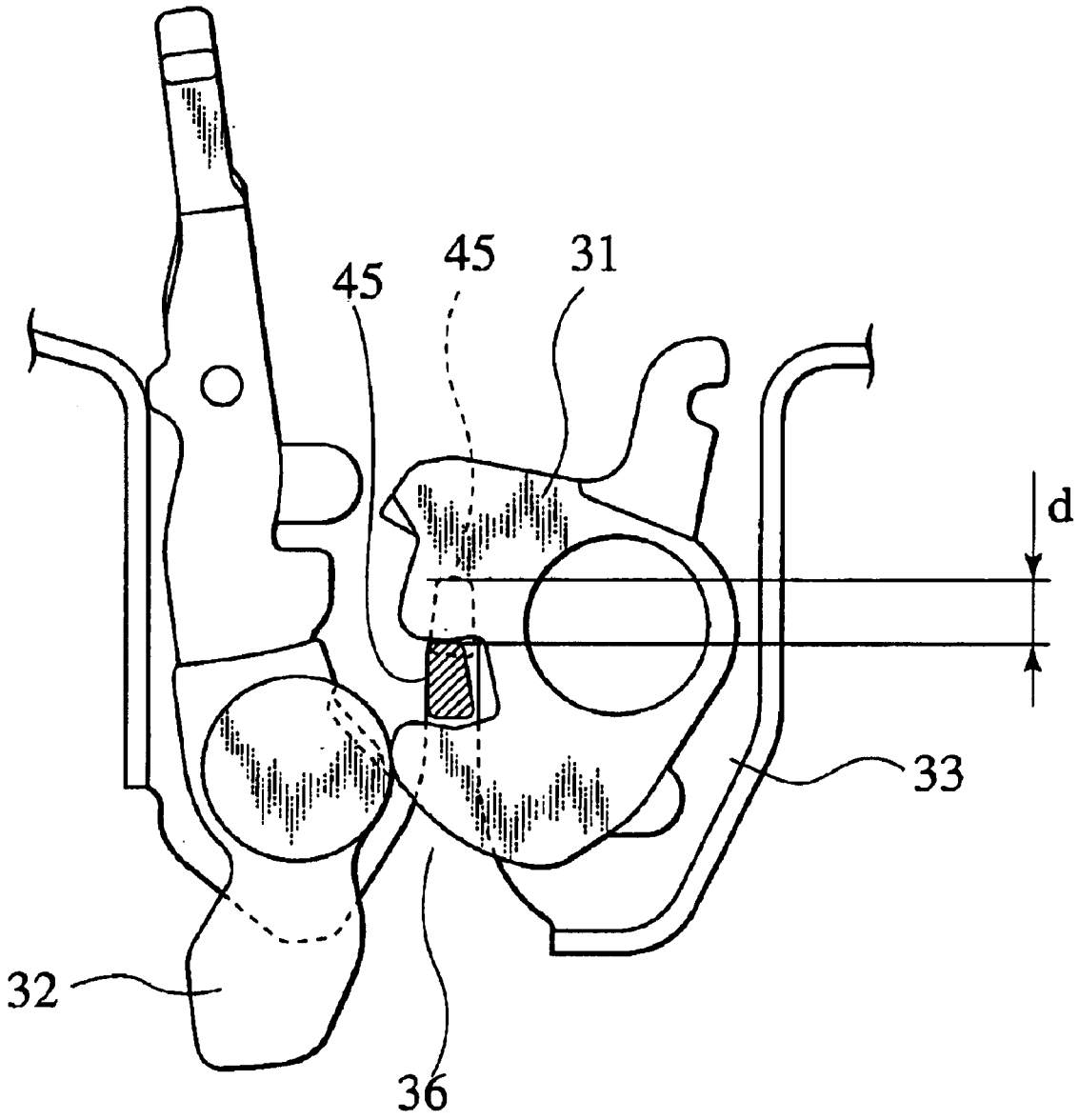
FIG. 9 is a front elevational view showing a state that a striker in the drive apparatus of the trunk lid is forcibly pushed up.

Next, when the output member 55 rotates, the cam follower 56 is relatively brought into slidable contact with the first cam 61 of the lock canceling member 60, as shown in FIG. 6. The cam follower 56 drives the lock canceling member 60 from the restricting position to the restriction canceling position, whereby the locking plate 32 swings from the restricting position to the restriction canceling position. The latch 31 becomes in the non-restricted state capable of removing from the striker 45, and the trunk lid 10 can be opened (shown in FIG. 9).

Furthermore, when the output member 55 rotates, the cam follower 56 moves within the cam groove 41, and when the switch 81 of the bring-in state detecting portion 80 reaches the first detected portion 55*b* of the output member 55, it is detected that the striker 45 returns to an initial waiting position, and then the drive motor stops.

Figure 7:
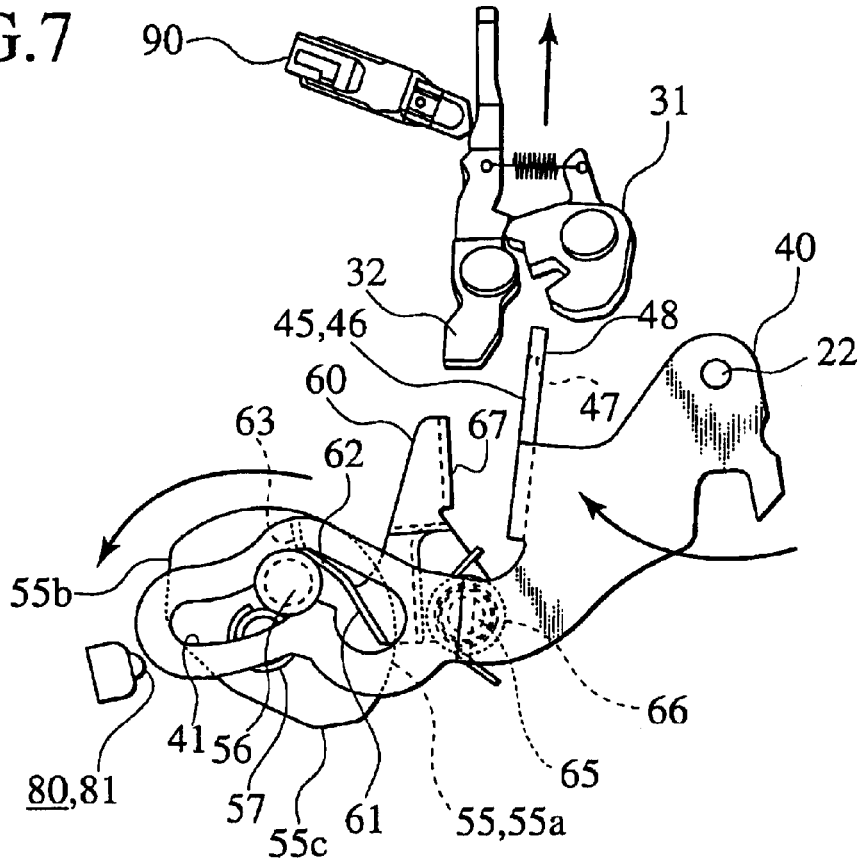
FIG. 7 is a front elevational view showing a state that the lock canceling member in the drive apparatus of the trunk lid is restricted at the restriction canceling position.

During the period that the striker 45 returns to the waiting position from the bring-in position, the cam follower 56 is relatively brought into slidable contact with the second cam 62 of the lock canceling member 60 as shown in FIG. 7 and the cam follower 56 restricts the lock canceling member 60 to the restriction canceling position, so that the locking plate 32 is maintained at the restriction canceling position and the latch 31 is maintained in the restriction canceling state capable of being removed from the striker 45.

After returning the striker 45 to the waiting position, the cam follower 56 is going to be relatively brought into slidable contact with the third cam 63 of the lock canceling member 60, as shown in FIG. 8. The cam follower 56 can move the lock canceling member 60 from the restriction canceling position to the restricting position. The lock canceling member 60 is moved from the restriction canceling position to the restricting position due to the urging force of the coil spring 66, whereby the locking plate 32 can be moved from the restriction canceling position to the restricted position.

When the trunk lid 10 is attached to the weather strip due to the frost of the vehicle body in the state that the trunk lid 10 can be opened, whereby the trunk lid 10 can not be sufficiently floated up, the lock canceling member 60 is restricted to the restriction canceling position during the period that the output member 55 returns the striker 45 to the waiting position, and the latch 31 is maintained in the restriction canceling state capable of removing from the striker 45, so that the latch 31 is never engaged with the striker 45 again. Accordingly, since the drive apparatus 20 does not erroneously operate in the state described above, the trunk lid 10 never close again. Therefore, it is possible to prevent the drive apparatus 20 from erroneously operating even in the case that there is not provided with the lid state detecting portion for detecting the opening and closing state of the trunk lid 10.

In the drive apparatus 20 of the trunk lid lock according to the embodiment described above, the output member 55 corresponding to the constituting part of the drive mechanism 50 for bringing in the striker 45 drives the lock canceling member 60 from the restricting position to the restriction canceling position. Accordingly, it is not necessary to specially provide with a part for driving the lock canceling member 60 from the restricting position to the restriction canceling position, so that it is possible to reduce the number of the parts.

In the embodiment described above, there is shown the structure in which the output member 55 drives the lock canceling member 60 by the cam mechanism structured such that the cam follower 56 is slidably in contact with the first cam 61 to the third cam 63, however, the mechanism for driving the lock canceling member 60 is not limited to the cam mechanism and may be a link mechanism or the like. Moreover, there is shown the structure in which the cam follower 56 is provided in the output member 55 and on the contrary, the first cam 61 to the third cam 63 are provided in the lock canceling member 60, however, the structure may be inversely made such that the cam follower is provided in the lock canceling member 60 and on the contrary, the cams are provided in the output member 55.

There is shown the structure in which the first cam 61 to the third cam 63 are formed in the lock canceling member 60, however, the third cam 63 is a conceptual element, so that the present invention is established even in the case that the third cam 63 is not formed in the lock canceling member 60. In the case that the third cam 63 is not formed, the cam follower 56 slidably contacting the first cam 61 to the second cam 62 is taken out from the second cam 62, whereby it is possible to return the lock canceling member 60 to the restricting position from the restriction canceling position due to the urging force of the coil spring 66.

In the drive apparatus of the trunk lid lock according to the present invention, the structure is made such that the lock canceling member is restricted at the restriction canceling position during the period that the first member is returned to the waiting position from the bring-in position, even in the case that the trunk lid is attached to the weather strip due to the frost of the vehicle body or the like and then the trunk lid does not sufficiently float up. Accordingly, the latch is maintained in the restriction canceling state capable of removing from the striker and the latch is not engaged with the striker again, whereby it is possible to prevent the drive apparatus from being erroneously operated. Since the opening and closing state of the trunk lid is detected, it is unnecessary that the lid state detecting portion for preventing the drive apparatus from being erroneously operated is not provided, so that the number of the parts can be reduced. The output member drives the lock canceling member from the restricting position to the restriction canceling position, so that it is unnecessary that the part for driving the lock canceling member is independently provided, and the number of the parts can be reduced.

Furthermore, the output member directly drives the lock canceling member, so that it is not necessary that a relaying part is provided between the output member and the lock canceling member, the number of the parts can be reduced and the lock canceling member can be securely operated.

What is claimed is:

1. A drive apparatus of a trunk lid lock for a motor vehicle, comprising:

a striker formed on the striker base provided in a peripheral edge portion of a trunk opening;

a latch provided in a trunk lid;

a drive mechanism having a lock canceling member and an output member, the lock canceling member including a first cam, a second cam and a third cam; and a support base fixed to an inner panel of the peripheral edge portion of the trunk opening, the lock canceling member being supported by a shaft on the support base, the drive mechanism being operative when the latch is engaged with the striker so as to bring in a second member including the latch via a first member including the striker moving to a bring-in position from a waiting position, thereby closing the trunk lid;

the lock canceling member being operative to move to a restricting position at which the latch is under a restricting state that the latch can not be taken out from the striker, and to a restriction canceling position at which the latch is under a restriction canceling state that the latch can be taken out from the striker;

the output member being relatively brought into slidable contact with the first cam at a time that the first member is returned to the waiting position from the bring-in position, whereby the lock canceling member is moved from the restriction position to the restriction canceling position;

during a period that the first member is returned to the waiting position from the bring-in position, the output member being relatively brought into slidable contact with the second cam, whereby the lock canceling member is restricted at the restriction canceling position; and after returning the first member to the waiting position, the output member being relatively brought into slidable contact with the third cam, whereby the lock canceling member can be moved from the restriction canceling position to the restricting position;

wherein the output member comprises a cam follower bringing in the second member via the first member, the cam follower being relatively brought into slidable contact with a cam groove formed in the first member, and the cam follower being relatively brought into slidable contact with the first cam, the second cam and the third cam in this order.

2. A drive apparatus of a trunk lid lock for a motor vehicle according to claim 1, wherein the second member is provided with a locking plate which can move to a restriction canceling position for placing the latch in a restriction canceling state.

3. A drive apparatus of a trunk lid lock for a motor vehicle according to claim 1, wherein the cam follower moves along a circumference, wherein the second cam is formed along the circumference at a time that the lock canceling member is at the restriction canceling position, and wherein the first cam and the third cam are respectively connected to both sides of the second cam, and are formed so as to gradually move close to or apart from a center of the circumference respectively.

4. A drive apparatus of a trunk lid lock for a motor vehicle according to claim 1, wherein the lock canceling member is urged from the restriction canceling position to the restricting position by a coil spring.

* * * * *